US009981825B2

(12) United States Patent
Hovi et al.

(10) Patent No.: US 9,981,825 B2
(45) Date of Patent: May 29, 2018

(54) MONITORING ELEVATOR TRACTION ROPE

(71) Applicant: KONE Corporation, Helsinki (FI)

(72) Inventors: Antti Hovi, Hyvinkää (FI); Ari Kattainen, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 382 days.

(21) Appl. No.: 14/812,700

(22) Filed: Jul. 29, 2015

(65) Prior Publication Data

US 2015/0329321 A1 Nov. 19, 2015

Related U.S. Application Data

(63) Continuation of application No. PCT/FI2014/050108, filed on Feb. 13, 2014.

(30) Foreign Application Priority Data

Feb. 22, 2013 (FI) ..... 20135174

(51) Int. Cl.

| | |
|---|---|
| ***B66B 1/34*** | (2006.01) |
| ***B66B 5/00*** | (2006.01) |
| ***B66B 1/24*** | (2006.01) |
| ***B66B 9/00*** | (2006.01) |

(52) U.S. Cl.

CPC ..... *B66B 5/0093* (2013.01); *B66B 1/24* (2013.01); *B66B 5/0037* (2013.01); *B66B 9/00* (2013.01)

(58) Field of Classification Search

CPC ..... B66B 5/0093; B66B 1/24; B66B 5/0037; B66B 9/00

USPC ..... 187/247, 391, 393, 394, 293, 294, 343, 187/344, 356, 361, 404

See application file for complete search history.

(56) References Cited

U.S. PATENT DOCUMENTS

| | | | | |
|---|---|---|---|---|
| 3,333,657 A * | 8/1967 | Innzuka | B66B 1/30 | 187/294 |
| 4,341,287 A * | 7/1982 | Kuzunuki | B66B 1/3492 | 187/394 |
| 4,467,895 A * | 8/1984 | Smith | B66B 1/3476 | 187/391 |

(Continued)

FOREIGN PATENT DOCUMENTS

| | | |
|---|---|---|
| CN | 101234719 A | 8/2008 |
| CN | 101679000 A | 3/2010 |

(Continued)

*Primary Examiner* — Anthony Salata

(74) *Attorney, Agent, or Firm* — Birch, Stewart, Kolasch & Birch, LLP

(57) ABSTRACT

A method and an arrangement are provided for monitoring the safety of a counterweighted elevator. In the method, an elevator car is driven with a hoisting machine towards the top end of the elevator hoistway, contact between the counterweight and the end buffer of the elevator hoistway is determined, a reference point for the location of the elevator car is registered when detecting contact between the counterweight and the end buffer, the distance that the elevator car travels onwards from the aforementioned reference point for the location is measured, and if the distance traveled by the elevator car onwards from the aforementioned reference point exceeds a threshold value a signal indicating a risk of slackening of the traction rope is formed.

20 Claims, 3 Drawing Sheets

(56) References Cited

U.S. PATENT DOCUMENTS

| | | | | |
|---|---|---|---|---|
| 5,157,228 | A * | 10/1992 | Ackermann | B66B 1/34 187/247 |
| 5,233,139 | A | 8/1993 | Hofmann | |
| 5,637,842 | A | 6/1997 | Yonemoto et al. | |
| 7,353,916 | B2 * | 4/2008 | Angst | B66B 5/02 187/314 |
| 7,849,975 | B2 * | 12/2010 | Ketonen | B66B 13/22 187/316 |
| 7,891,467 | B2 * | 2/2011 | Kattainen | B66B 5/0056 187/316 |
| 8,123,003 | B2 * | 2/2012 | Meri | B66B 1/3492 187/247 |
| 8,162,108 | B2 * | 4/2012 | Sirigu | B66B 5/0068 187/289 |
| 8,261,885 | B2 * | 9/2012 | Ketoviita | B66B 5/0043 187/314 |
| 8,807,286 | B2 * | 8/2014 | Puranen | B66B 5/0018 187/391 |
| 9,714,155 | B2 * | 7/2017 | Tyni | B66B 3/00 |
| 2004/0251086 | A1 | 12/2004 | Huber et al. | |
| 2008/0185232 | A1 | 8/2008 | Henneau | |
| 2010/0300813 | A1 | 12/2010 | Kigawa et al. | |
| 2012/0006627 | A1 | 1/2012 | Carparelli et al. | |

FOREIGN PATENT DOCUMENTS

| | | | |
|---|---|---|---|
| DE | 10 2009 001 057 | A1 | 9/2010 |
| EP | 0 390 972 | A1 | 10/1990 |
| EP | 1 407 907 | A1 | 4/2004 |
| EP | 1 953 108 | A1 | 8/2008 |
| EP | 2 292 546 | A1 | 3/2011 |
| JP | 3-186584 | A | 8/1991 |
| JP | 5-278964 | A | 10/1993 |
| JP | 2006-117399 | A | 5/2006 |
| JP | 2007-39240 | A | 2/2007 |

* cited by examiner

Legend

1 - traction ropes
2 - elevator car
3 - hoisting machine
4 - elevator hoistway
5 - counterweight
6 - end buffer
7 - end limit identifier
8 - marking piece
9 - reader
10 - manual user interface
11 - elevator control unit
12 - frequency converter
13 - monitoring apparatus
14 - traveling cable
17 - elongated marking piece

Legend
1 - traction rope
3 - hoisting machine
3A - traction sheave
3B - stationary frame part
3C - mechanical brake

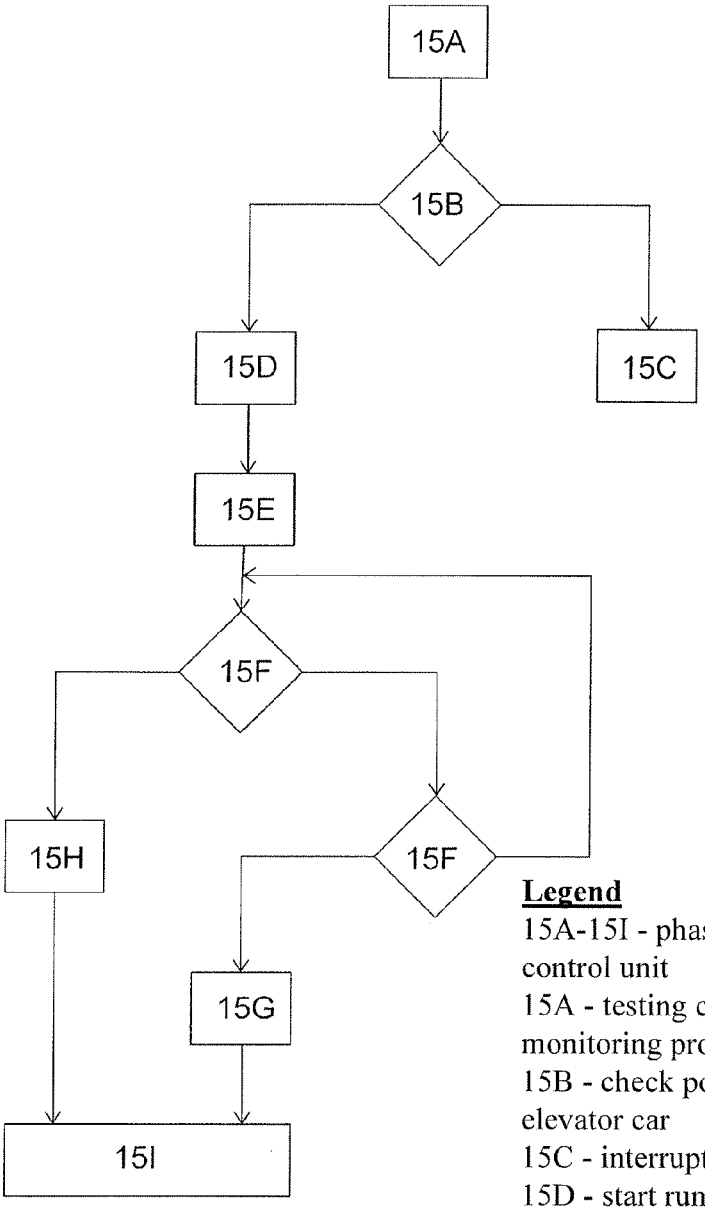

Fig. 3

Legend

15A-15I - phases of elevator control unit

15A - testing command to starting monitoring program

15B - check position signal of elevator car

15C - interrupt testing program

15D - start run towards top end of elevator hoistway

15E - receive change in drive torque and register point where point detected

15F - measure distance travelled by elevator car

15G - record detected risk of slackening

15H - records memory information of elevator system

15I - drive elevator car to nearest stopping floor

MONITORING ELEVATOR TRACTION ROPE

CROSS REFERENCE TO RELATED APPLICATIONS

This application is a Continuation of PCT International Application No. PCT/FI2014/050108 filed on Feb. 13, 2014, which claims priority under 35 U.S.C. 119(a) to Patent Application No. 20135174, filed in Finland on Feb. 22, 2013, all of which are hereby expressly incorporated by reference into the present application.

FIELD OF THE INVENTION

The invention relates to the safety of elevators and more particularly to methods and arrangements for monitoring the risk of slackening of a traction rope of a counterweighted elevator.

BACKGROUND OF THE INVENTION

An elevator car is driven in an elevator hoistway with a hoisting machine. The moving force is transmitted from the hoisting machine to the elevator car and also to the counterweight through a traction rope traveling via a traction sheave of the hoisting machine. If the friction between the traction sheave and the traction rope is too low, the traction rope is able to slide on the traction sheave when accelerating or decelerating with the hoisting machine. If the friction is high, the traction rope is not able to slide on the traction sheave, even in a situation in which the counterweight or the elevator car grips the guide rail or some other structure of the elevator hoistway during a run with the elevator. In this case the elevator car/counterweight continues its progress when the traction sheave rotates owing to the high friction, although the traction rope on the other side of the traction sheave at the same time starts to slacken owing to the gripped counterweight/elevator car. Slackening of the traction rope might result in a dangerous situation, if the gripped counterweight/elevator car suddenly detaches and, owing to the slackening of the traction rope, is able to fall freely in the elevator hoistway. On the other hand, slackening of the traction rope can also result in the final loss of friction between the traction sheave and the traction rope, in which case the traction rope is able to slide uncontrollably on the traction sheave.

Aim of the Invention

The aim of the invention is to solve the aforementioned problems as well as the problems disclosed in the description below. One aim of the invention is to disclose a solution for monitoring the risk of slackening of a traction rope. To achieve this aim the invention discloses a method according to claim 1 and also an arrangement according to claim 7. The preferred embodiments of the invention are described in the dependent claims. Some inventive embodiments and inventive combinations of the various embodiments are also presented in the descriptive section and in the drawings of the present application.

SUMMARY OF THE INVENTION

One aspect of the invention is a method for monitoring the safety of a counterweighted elevator. In the method an elevator car is driven with a hoisting machine towards the top end of the elevator hoistway, contact between the counterweight and the end buffer of the elevator hoistway is determined, a reference point for the location of the elevator car is registered when detecting contact between the counterweight and the end buffer, the distance that the elevator car travels onwards from the aforementioned reference point of the location is measured, and if the distance traveled by the elevator car onwards from the aforementioned reference point exceeds a defined threshold value, a signal indicating a risk of slackening of the traction rope is formed. In some embodiments the aforementioned threshold value is defined on the basis of the nominal compression of the buffer in such a way that the magnitude of the threshold value is the nominal compression plus a defined margin of error. In some embodiments the nominal compression of the buffer is determined on the basis of the rated speed of the elevator, i.e. on the basis of the top speed during normal operation of the elevator in such a way that when the rated speed increases the nominal compression of the buffer also increases. End buffer refers here to a structure fitted in connection with the end of the elevator hoistway, which structure is fitted on a collision course with a counterweight approaching the end of the elevator hoistway and in the design of which structure the mechanical contact between the aforementioned counterweight and the end buffer has been taken into account.

In the description the term "traction rope" must be broadly understood to include, in addition to conventional metal ropes, also inter alia belts in which pulling strands made e.g. of metal or fiber have been fitted into an elastomer matrix.

The operation of the invention is based on the fact that if the drive apparatus of an elevator is correctly dimensioned, the movement of the elevator car towards the end of the elevator hoistway will be stopped within the limits of the aforementioned threshold value when the counterweight is on the end buffer. The correct dimensioning of the drive apparatus can be implemented by, inter alia, selecting the friction between the traction sheave and the traction rope to be sufficiently low, in which case the traction sheave starts to slip when the counterweight is on the end buffer. On the other hand, the drive apparatus of the elevator can comprise e.g. a mechanical or microprocessor-controlled torque limiter with which the torque of the hoisting machine is limited to be so low that the traction sheave stops when the counterweight collides with the end buffer and slackening of the traction rope is not in that case possible. This type of solution is advantageous particularly if there is high friction between the traction sheave and the traction rope. The friction between the traction sheave and the traction rope can be influenced e.g. with the coating/surface material of the traction sheave as well as with the selection of the material, type of lay and lubricant of the traction rope and/or with the selection of the number of parallel ropes. The friction between the traction sheave and the traction rope is also often high in those embodiments of the invention in which parallel metal ropes traveling via the traction sheave are replaced with a belt, in which metal or fiber pulling strands have been fitted inside a polymer matrix or corresponding structure. The friction between the traction sheave and the traction rope is also often high in those embodiments of the invention in which parallel metal ropes are replaced with a toothed belt, which travels in grooves made in the traction sheave for the toothed belt.

With the aid of the invention the risk of slackening of a traction rope can be monitored in a controlled manner and consequently slackening of the traction rope can be prevented in advance during normal operation of the elevator.

From this it follows that by means of the invention those dangerous situations during normal operation of the elevator subsequent to slackening of the traction rope that are described above can also be avoided. According to the invention, monitoring of the slackening of the traction rope can be performed automatically by entering a starting command for the monitoring process e.g. from a manual user interface outside the elevator hoistway. In some embodiments a monitoring command is entered from a remote monitoring center for the elevators. In some embodiments a monitoring command is activated automatically during times of quiet traffic (e.g. at night-time) when the doors of the elevator car are closed and the elevator car is empty. Consequently monitoring of the risk of slackening of the traction rope can be performed without human work or the need for human work is very small. Monitoring of the risk of slackening of the traction rope can also be regular.

For the monitoring procedures being presented in the description, the elevator car is first removed from normal operation by separating the elevator car from the elevator calls served by it. Before starting the monitoring procedures, the doors of the elevator car are also closed and it is ensured, e.g. with the car load-weighing device, that the elevator car is empty.

In one preferred embodiment of the invention the drive torque of the hoisting machine is checked and contact between the counterweight and the end buffer of the elevator hoistway is registered when detecting a required change in the drive torque of the hoisting machine. This means that contact between the counterweight and the end buffer of the elevator hoistway can be detected without separate measuring devices, utilizing information available from the drive device of the hoisting machine, such as from the frequency converter, about the drive torque of the hoisting machine. On the other hand, e.g. a mechanical switch or contactless proximity sensor, fitted for this purpose separately to the buffer, can also be used for detecting contact between the counterweight and the end buffer of the elevator hoistway.

In one preferred embodiment of the invention the movement of the elevator car is measured, and if the elevator car stops, the distance traveled by the elevator car onwards from the reference point is recorded in memory. Consequently the aforementioned distances recorded in memory can be used for monitoring the condition of the drive apparatus of the elevator, e.g. in such a way that if the trend indicates the recorded distances are lengthening and approaching the aforementioned threshold value, a service person is instructed to repair the drive apparatus for reducing the risk of slackening of the rope. In one preferred embodiment of the invention, if the elevator car stops, the run is stopped with the hoisting machine so that the drive apparatus of the elevator does not overload e.g. owing to slipping of the traction rope.

In one preferred embodiment of the invention, if the distance traveled by the elevator car onwards from the reference point exceeds the aforementioned threshold value, the run is stopped with the hoisting machine. In some embodiments the elevator is removed from service and information about the removal from service is recorded in non-volatile memory. In this case starting of the next run of the elevator is prevented on the basis of the aforementioned information recorded in non-volatile memory. In addition, a notification about the removal of the elevator from service is presented on the display of the user interface of the elevator. In some embodiments information about the removal of an elevator from service is also sent to a service center for the elevators via a remote connection.

In one preferred embodiment of the invention the extreme limit switch indicating the extreme limit of permitted movement of the elevator car in the top end of the elevator hoistway is bypassed. This means that the elevator car can drive past the extreme limit switch towards the end of the elevator hoistway without the operation of the extreme limit switch interrupting the run with the elevator.

In one preferred embodiment of the invention a testing command is entered from a manual user interface disposed outside the elevator hoistway for starting the method according to the description. This means that the risk of slackening of the traction rope can be tested without a serviceman needing to go into the elevator hoistway.

A second aspect of the invention is an arrangement for monitoring the safety of an elevator. The arrangement comprises an elevator car, a counterweight, a hoisting machine, a traction rope traveling via the traction sheave of the hoisting machine, which traction rope is arranged to pull the elevator car and the counterweight with the driver torque produced by the hoisting machine, a drive device of the hoisting machine, which drive device is arranged to drive the elevator car by supplying electric power to the electric motor in the hoisting machine, a measuring device fitted in connection with the elevator car for measuring the distance traveled by the elevator car, and a monitoring apparatus connected to the drive device of the hoisting machine as well as to the aforementioned measuring device, which monitoring apparatus is configured to start a run of the elevator car towards the top end of the elevator hoistway, to determine contact between the counterweight and the end buffer of the elevator hoistway, to register a reference point of the location of the elevator car when detecting contact between the counterweight and the end buffer, to measure the distance that the elevator car travels onwards from the aforementioned reference point for the location, and to form a signal indicating a risk of slackening of the traction rope if the distance traveled by the elevator car onwards from the aforementioned reference point exceeds a defined threshold value.

In one preferred embodiment of the invention the monitoring apparatus is configured to check the drive torque of the hoisting machine, and to register a reference point for the location of the elevator car when it detects a required change in the drive torque of the hoisting machine.

In one preferred embodiment of the invention the monitoring apparatus is configured to measure the movement of the elevator car, and if the elevator car stops to record in memory the distance traveled by the elevator car onwards from the reference point.

In one preferred embodiment of the invention the monitoring apparatus is configured to stop a run with the hoisting machine if the distance traveled by the elevator car onwards from the reference point exceeds the aforementioned threshold value or if the elevator car stops.

In one preferred embodiment of the invention the monitoring apparatus is configured to bypass the final limit switch indicating the extreme limit of permitted movement of the elevator car in the top end of the elevator hoistway.

In one preferred embodiment of the invention the arrangement comprises a manual user interface for activating the testing function, according to the description, that monitors the risk of slackening of the traction rope.

The preceding summary, as well as the additional features and additional advantages of the invention presented below, will be better understood by the aid of the following description of some embodiments, said description not limiting the scope of application of the invention.

BRIEF EXPLANATION OF THE FIGURES

FIG. 3 presents as a flow chart the monitoring function for the risk of slackening of the traction rope according to an embodiment of the invention.

MORE DETAILED DESCRIPTION OF PREFERRED EMBODIMENTS OF THE INVENTION

Figure 1A:
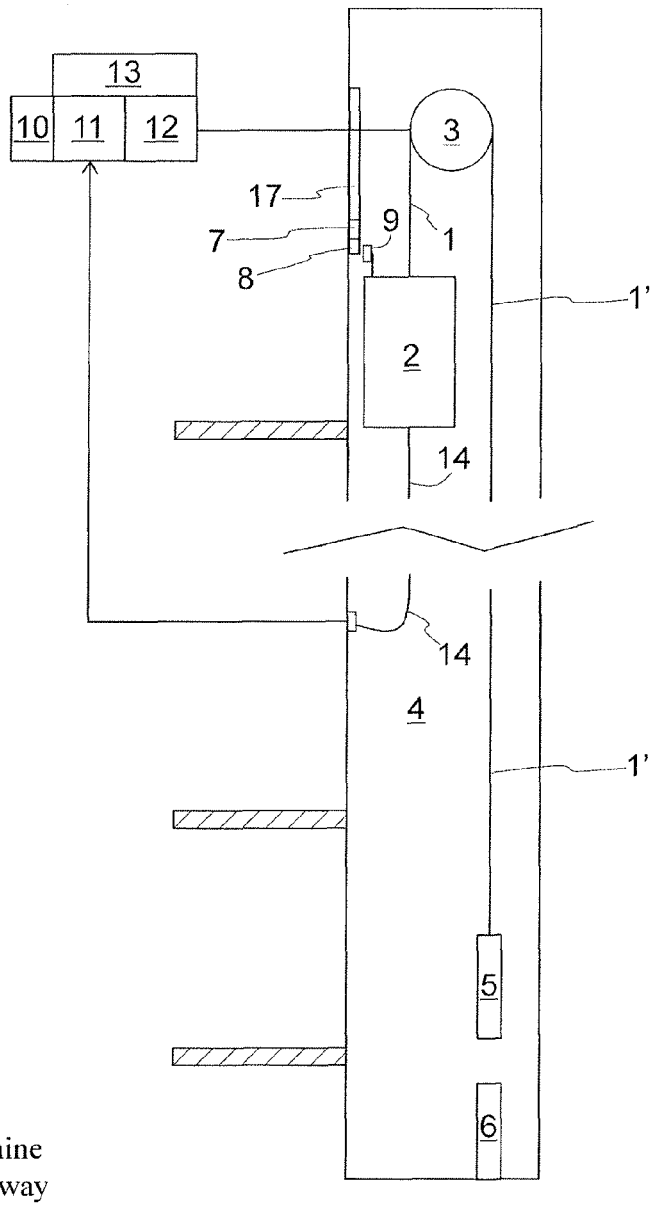
FIG. 1*a* presents as a block diagram an arrangement according to one embodiment of the invention.

FIG. 1*a* presents an arrangement for preventing slackening of the traction rope 1 of an elevator. To clarify the explanation, FIG. 1*a* presents only the features of the elevator system that are essential from the viewpoint of understanding the invention. According to FIG. 1*a*, the elevator car 2 is driven in the elevator hoistway 4 by the hoisting machine 3 along a vertical trajectory determined by guide rails (the guide rails of the elevator car/counterweight are not presented in FIG. 1*a*). The drive torque of the hoisting machine is achieved with a permanent-magnet synchronous motor belonging to the hoisting machine 3, and the drive torque is transmitted from the hoisting machine 3 to the elevator car 2 and to the counterweight 5 through traction ropes 1 traveling via the traction sheave of the hoisting machine 3. The speed of the elevator car 2 is adjusted to be according to the target value for the speed of the elevator car 2 calculated by the elevator control unit 11, i.e. according to the speed reference. The speed reference is formed in such a way that the passengers can be transferred with the elevator car from one floor to another on the basis of elevator calls given by elevator passengers (the call-giving devices are not presented in FIG. 1*a*). The speed of the elevator car 2 is adjusted by adjusting the flow of electric power in the permanent-magnet synchronous motor of the hoisting machine 3 with a frequency converter 12.

A marking piece 8 is fitted in connection with the entrance to the elevator hoistway on each floor, which marking piece is read by a reader 9 moving along with the elevator car 2, which reader is configured to read the marking piece 8 when the reader 9 is situated on the horizontal plane opposite the marking piece 8. The marking piece 8 indicates to the reader 9 the location of the elevator car 2 at the point of the stopping floor. During normal operation of the elevator, the elevator car 2 starts moving from the point of the marking piece 8 and stops at the point of the marking piece 8 in the elevator hoistway 4. The elevator control unit 11 receives information about an arrival at the stopping floor from the reader 9 via a traveling cable 14.

The elevator system of FIG. 1*a* is an elevator system without machine room, in which system the hoisting machine 3 and the frequency converter 12 are disposed in the elevator hoistway 4, and the elevator control unit 11 is disposed on a stopping floor in connection with the frame of the hoistway door. In some other embodiments, however, the elevator system has a machine room, in which case the hoisting machine 3, frequency converter 12 and elevator control unit 11 are disposed in a separate machine room.

In the elevator system of FIG. 1*a* the elevator car 2 and the counterweight 5 are suspended in the elevator hoistway 4 with traction ropes 1 traveling via the traction sheave of the hoisting machine 3. In some other embodiments the suspension ropes and the traction ropes 1 of the elevator car 2 and of the counterweight 5 are differentiated from each other in such a way that in the elevator system are suspension ropes, which are used only for suspending the elevator car 2 and the counterweight 5, and traction ropes 1 separate from the suspension ropes, which traction ropes are not used for suspension but instead by means of which the drive torque of the hoisting machine 3 is transmitted to the elevator car 2 and to the counterweight 5. In some embodiments the parallel traction ropes 1 traveling via the traction sheave are implemented with a toothed belt.

In some embodiments the elevator comprises two or more counterweights 5, which are driven with the same hoisting machine 3.

Figure 2:
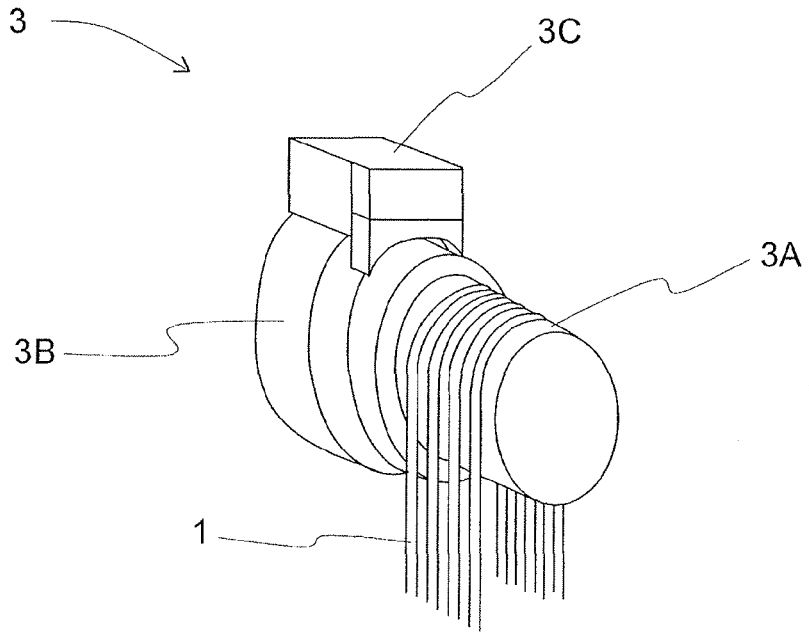
FIG. 2 presents in more detail the hoisting machine in the arrangement of FIG. 1.

FIG. 2 presents in more detail the hoisting machine of FIG. 3 of FIG. 1*a*. The parallel metal traction ropes 1 travel in the grooves of the traction sheave 3A of the hoisting machine 3. The stator of the permanent-magnet synchronous motor of the hoisting machine 3 is in the stationary frame part 3B of the hoisting machine and the rotor is integrated into the rotating traction sheave 3A. During a standstill of the elevator, the traction sheave 3A is locked into position with a mechanical brake 3C that is on the frame part 3B of the hoisting machine.

If the friction between the grooves of the traction sheave 3A and the traction ropes 1 is too low, the traction ropes 1 are able to slide uncontrollably in the grooves of the traction sheave 3A when accelerating and when braking with the hoisting machine 3. If the friction between the grooves of the traction sheave 3A and the traction ropes 1 is high, the traction ropes 1 are not able to slide in the grooves of the traction sheave 3A, not even if/when the counterweight 5 grips the guide rail when driving the elevator car 2 upwards, or if/when the elevator car 2 grips the guide rail when driving the counterweight 5 upwards. When the counterweight 5 grips, an upward-moving elevator car 2 continues its progress as the traction sheave 3A rotates owing to the high friction. When the movement of the elevator car 2 continues, the traction ropes 1' disposed between the traction sheave 3A and the counterweight 5 start to slacken. Slackening of the traction ropes 1' might result in a dangerous situation, if the gripped counterweight 5 suddenly detaches and, owing to the slackening of the traction ropes 5, is able to fall freely in the elevator hoistway 4.

A dangerous situation might also arise if a serviceman is on the roof of the elevator car 2 in a situation in which the counterweight 5 is in the bottom end of the elevator hoistway 4 pressed against the end buffer 6 and the elevator car 2 is driven upwards with the hoisting machine 3. If the traction ropes 1 do not slip in the grooves of the traction sheave 3A, the elevator car 2 is able to move upwards when the traction ropes 1' slacken and the serviceman is in danger of being squashed between the elevator car 2 and the roof of the elevator hoistway 4.

Owing to the aforementioned reasons, among others, it is endeavored to design an elevator in such a way that movement of the elevator car 2 and of the counterweight 5 stops when either the elevator car 2 or the counterweight 5 gets stuck in the elevator hoistway 4. The friction between the traction ropes 1 and the grooves of the traction sheave 3A can be dimensioned to be sufficiently low, in which case the traction ropes 1 start to slip in the grooves of the traction sheave 3A when the counterweight 5 or the elevator car 2 grips. On the other hand, the elevator can comprise e.g. a mechanical or microprocessor-controlled torque limiter with which the torque of the hoisting machine 3 is limited in such a way that the hoisting machine 3 is able to form the torque needed for slackening of the traction ropes 1. This type of solution is advantageous also in those embodiments of the invention in which a belt is used as a traction rope 1 instead of separate parallel metal ropes, in which belt metal or fiber pulling strands have been fitted inside an elastomer matrix. The solution is advantageous also in those embodiments of the invention in which the traction rope 1 has been implemented with a toothed belt, which travels in grooves, shaped according to the toothed belt, on the traction sheave 3A and, that being the case, is not able to slip on the traction sheave 3A.

The friction between the traction ropes 1 and the grooves of the traction sheave 3A can increase during operation of the elevator e.g. as a consequence of damage to the traction rope/ropes 1 and/or the traction sheave 3A. The magnitude of the friction can also be affected with the selection of the lubricant of the traction ropes 1. A defect or malfunction of the toque limiter, on the other hand, can cause the maximum torque of the hoisting machine to increase to be too large, causing the aforementioned risk of slackening of the traction ropes 1.

For the aforementioned reasons, among others, the elevator system of FIG. 1*a* is provided with a monitoring apparatus 13, which is configured to monitor the risk of slackening of the traction ropes 1 of the elevator. A program code is added to the software of the frequency converter 12 and of the elevator control unit 11, which code the microprocessors of the frequency converter 12 and of the elevator control unit 11 implement. According to the program code, the frequency converter 12 and elevator control unit 11 work together as a monitoring apparatus 13, which implements the monitoring program presented as a flow chart in FIG. 3.

Before activation of the monitoring program, the elevator car 2 is driven beforehand to the topmost floor. A serviceman separates the elevator calls that are given with call-giving devices and are served by the elevator car 2 by entering a separation command from the manual user interface 10 of the elevator control unit, and also ensures that the elevator car 2 is empty and that the doors of the elevator car 2 are closed.

After this the serviceman enters a testing command from the manual user interface 10 of the elevator control unit, which command activates the monitoring program presented in the flow chart of FIG. 3.

According to FIG. 3, in phase 15A the elevator control unit 11 receives a testing command from the manual user interface 10, which command starts the monitoring program.

After this, in phase 15B, the elevator control unit 11 checks on the basis of the positioning signal being received from the reader 9 that the elevator car 2 is at the topmost floor.

If the elevator car 2 is not at the topmost floor, the elevator control unit 11 moves to phase 15C and interrupts the testing program.

If the elevator car 2 is at the topmost floor, execution of the program moves to phase 15D, in which the elevator control unit 11 starts a run towards the top end of the elevator hoistway 4 at a low speed, most preferably approx. 0.05 m/s, by sending a run command to the frequency converter 12. An end limit identifier 7 readable with a reader 9 is disposed in the elevator hoistway above the topmost floor, which identifier bounds the top limit of permitted movement of the elevator car 4 during normal operation of the elevator. The reader 9 detects the end limit identifier 7 when the elevator car 2 has moved approx. 10-30 centimeters from the topmost stopping floor towards the top end of the elevator hoistway 4. During normal operation of the elevator the elevator control unit 11 interrupts a run with the elevator when it receives from the reader 9 information about an arrival at the end limit identifier; during execution of the monitoring program the elevator control unit 11 allows, however, a run to continue past the end limit identifier 7 and onwards towards the top end of the elevator hoistway 4. When driving the elevator car 2 upwards the elevator control unit 11 continuously receives a positioning signal of the elevator car 2 from the reader 9. In this embodiment of the invention an elongated marking piece 17 is fitted in connection with the top end of the elevator hoistway 2, by reading which the reader 9 determines the vertical location of the elevator car 2 in the proximity of the top end of the elevator hoistway 4. In some other embodiments the location of the elevator car is measured with an encoder, which engages with the rotating movement of the rope pulley of the overspeed governor of the elevator. In some other embodiments the location of the elevator car is measured with a wireless distance meter, which measures the distance of the elevator car 2 from the top end of the elevator hoistway 4.

Figure 1B:
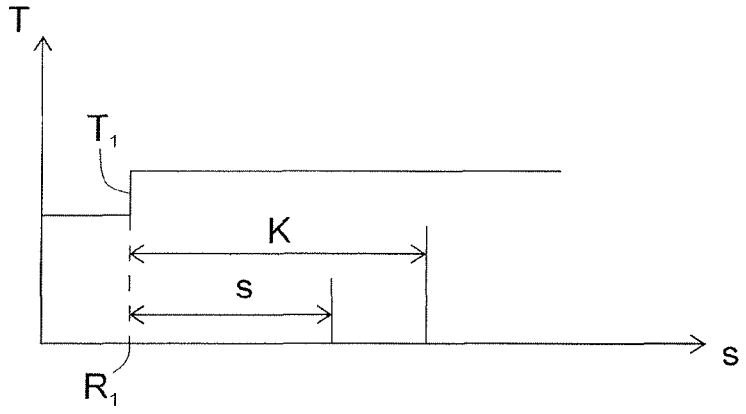
FIG. 1*b* presents, as a function of the position of the elevator car, the drive torque of the hoisting machine driving the elevator car in the arrangement towards the top end of the elevator hoistway.

When driving the elevator car 2 upwards, the frequency converter 12 continuously checks the drive torque of the hoisting machine 3. FIG. 1*b* presents the aforementioned drive torque T as a function of the location s of the elevator car. The frequency converter 12 compares the drive torque to the predefined graph for drive torque in the memory of the frequency converter 12. When the elevator car 2 is located at the point $R_1$ the frequency converter 12 registers the change $T_1$ in the drive torque T corresponding to the graph for drive torque recorded in memory, in which case the testing program moves to phase 15E.

The detected change $T_1$ in drive torque means that the counterweight 5 has arrived on the end buffer 6 of the elevator hoistway and is starting to press against the end buffer 6. The frequency converter 12 sends information about the aforementioned change $T_1$ in drive torque to the elevator control unit 11, which registers the point $R_1$, where the aforementioned change $T_1$ was detected, as a reference point for the location of the elevator car, and the monitoring program moves to phase 15F.

After this, in phase 15F of the monitoring program, the elevator control unit 11 starts to measure, by means of the positioning signal being received from the reader 9, the distance Δs that the elevator car 2 travels onwards from the reference point $R_1$ of the location. The elevator control unit 11 compares the distance Δs traveled to the threshold value K recorded in the memory of the elevator control unit 11. If the elevator car 2 stops before the distance Δs traveled by the elevator car exceeds the threshold value K, execution of the monitoring program moves to phase 15H. In phase 15H the elevator control unit 11 records in memory information that the elevator system is operating normally. The elevator control unit 11 also records in memory the distance Δs traveled by the elevator car 2 and sends the reading recorded in memory via a remote connection to a service center for elevators, where it can be utilized in the condition monitoring of the elevator, e.g. in such a way that if the trend of the distances Δs traveled from the reference point $R_1$ by the elevator car 2 starts to approach the threshold value K, a serviceman of the elevator can be instructed, already in advance, to perform the changes needed so that the value Δs of the distance traveled remains within the permitted limits.

If the distance Δs traveled by the elevator car 2 exceeds the threshold value K before the elevator car 2 stops, the elevator control unit 11 moves to phase 15G and records information about the detected risk of slackening of the traction ropes 1. The elevator control unit 11 also forms a signal indicating a risk of slackening of the traction ropes 1, which signal is also presented on the display of the manual user interface 10 of the elevator control unit 11. In addition, the elevator control unit 11 sends information about the risk of slackening of the traction ropes 1 via a remote connection—such as a GSM connection or an Internet connection—to the service center for the elevators.

If the distance Δs traveled by the elevator car 2 exceeds the threshold value K or if the elevator car 2 stops, execution of the monitoring program moves in any case on to phase 15I, in which a run of the hoisting machine is stopped by disconnecting the power supply to the permanent-magnet synchronous motor of the hoisting machine and also by activating the machinery brake 3C.

Stopping of the elevator car in phase 15F means that the traction ropes 1 start to slip on the traction sheave 3A or the mechanical or microprocessor-controlled torque limiter of the hoisting machine is functioning correctly. Consequently the prevention mechanism for slackening of the traction rope 1 functions as it should and the risk of slackening of the traction rope 1 is not significant.

In some embodiments, after it has detected a risk of slackening of the traction ropes 1 in phase 15G the elevator control unit 11 drives the elevator car 2 to the nearest stopping floor, after which normal operation of the elevator is prevented. Prevention of use the elevator during normal operation of the elevator is based on the observation recorded in memory about the risk of slackening of the traction ropes 1. Consequently, normal operation of the elevator is possible only after a serviceman has visited and reset the aforementioned observation from the manual user interface 10 of the elevator control unit.

The threshold value K for the distance Δs traveled by the elevator car 2 is determined on the basis of the nominal compression of the end buffer 6 in such a way that the magnitude of the threshold value K is the nominal compression plus a defined margin of error. The nominal compression is determined on the basis of the rated speed of the elevator car 2. Of course, the threshold value K could also be determined in some other way, i.e. to be shorter or longer, but the preceding calculation method has been observed to have achieved a sufficiently large value for the threshold value K to prevent erroneous monitoring notifications and, on the other hand, a sufficiently small value to prevent an unnecessarily large amount of slipping of the traction sheave or, on the other hand, an unnecessarily large amount of slackening of the traction ropes 1 in connection with monitoring.

In the preceding description, the program for monitoring for the risk of slackening of the traction rope 1 was implemented with additions made to the software of the elevator control unit 11 and the frequency converter 12. There could, however, be a completely separate device 13 in the elevator system for performing the monitoring. On the other hand, the monitoring program could also be implemented just, or mostly, with additions to the software of the frequency converter 12.

The invention is described above by the aid of a few examples of its embodiment. It is obvious to the person skilled in the art that the invention is not only limited to the embodiments described above, but that many other applications are possible within the scope of the inventive concept defined by the claims.

The invention claimed is:

1. A method for monitoring the safety of a counterweighted elevator, comprising the steps of:

driving the elevator car with the hoisting machine towards the top end of the elevator hoistway;

determining contact between the counterweight and the end buffer of the elevator hoistway;

registering a reference point for the location of the elevator car when detecting contact between the counterweight and the end buffer;

measuring the distance that the elevator car travels onwards from the reference point of the location; and if the distance traveled by the elevator car onwards from the reference point exceeds a threshold value, forming a signal indicating a risk of slackening of the traction rope.

2. The method according to claim 1, further comprising the steps of:

checking the drive torque of the hoisting machine; and registering contact between the counterweight and the end buffer of the elevator hoistway when a required change is detected in the drive torque of the hoisting machine.

3. The method according to claim 1, further comprising the steps of:

measuring the movement of the elevator car; and if the elevator car stops, recording the distance traveled by the elevator car onwards from the reference point in memory.

4. The method according to claim 1, further comprising the step of:

if the distance traveled by the elevator car onwards from the reference point exceeds the threshold value or if the elevator car stops, stopping the run with the hoisting machine.

5. The method according to claim 1, further comprising the step of:

bypassing the extreme limit switch indicating the extreme limit of permitted movement of the elevator car in the top end of the elevator hoistway.

6. The method according to claim 1, further comprising the step of:

entering a command from a manual user interface for starting the method.

7. An arrangement for monitoring the safety of an elevator, comprising:

an elevator car;

a counterweight;

a hoisting machine;

a traction rope traveling via the traction sheave of the hoisting machine, the traction rope being arranged to pull the elevator car and the counterweight with the driver torque produced by the hoisting machine;

a drive device of the hoisting machine, the drive device being arranged to drive the elevator car by supplying electric power to the electric motor in the hoisting machine;

a measuring device fitted in connection with the elevator car for measuring the distance traveled by the elevator car; and a monitoring apparatus connected to the drive device of the hoisting machine and also to the measuring device, the monitoring apparatus being configured:

to start a run of the elevator car towards the top end of the elevator hoistway;

to determine contact between the counterweight and the end buffer of the elevator hoistway;

to register a reference point for the location of the elevator car when detecting contact between the counterweight and the end buffer;

to measure the distance that the elevator car travels onwards from the reference point for the location; and to form a signal indicating a risk of slackening of the traction rope, if the distance traveled by the elevator car onwards from the reference point exceeds the threshold value.

8. The arrangement according to claim 7, wherein the monitoring apparatus is configured:

to check the drive torque of the hoisting machine; and to register a reference point of the location of the elevator car when it detects a required change in the drive torque of the hoisting machine.

9. The arrangement according to claim 7, wherein the monitoring apparatus is configured:

to measure the movement of the elevator car; and when the elevator car stops, to record in memory the distance traveled by the elevator car onwards from the reference point.

10. The arrangement according to claim 7, wherein the monitoring apparatus is configured to stop a run with the hoisting machine, if the distance traveled by the elevator car onwards from the reference point exceeds the threshold value or if the elevator car stops.

11. The arrangement according to claim 7, wherein the monitoring apparatus is configured to bypass the final limit switch indicating the extreme limit of permitted movement of the elevator car in the top end of the elevator hoistway.

12. The arrangement according to claim 7, wherein the arrangement comprises a manual user interface for activating the testing function monitoring the risk of slackening of the traction rope.

13. The method according to claim 2, further comprising the steps of:

measuring the movement of the elevator car; and if the elevator car stops, recording the distance traveled by the elevator car onwards from the reference point in memory.

14. The method according to claim 2, further comprising the step of:

if the distance traveled by the elevator car onwards from the reference point exceeds the threshold value or if the elevator car stops, stopping the run with the hoisting machine.

15. The method according to claim 3, further comprising the step of:

if the distance traveled by the elevator car onwards from the reference point exceeds the threshold value or if the elevator car stops, stopping the run with the hoisting machine.

16. The method according to claim 2, further comprising the step of:

bypassing the extreme limit switch indicating the extreme limit of permitted movement of the elevator car in the top end of the elevator hoistway.

17. The method according to claim 3, further comprising the step of:

bypassing the extreme limit switch indicating the extreme limit of permitted movement of the elevator car in the top end of the elevator hoistway.

18. The method according to claim 4, further comprising the step of:

bypassing the extreme limit switch indicating the extreme limit of permitted movement of the elevator car in the top end of the elevator hoistway.

19. The arrangement according to claim 8, wherein the monitoring apparatus is configured:

to measure the movement of the elevator car; and when the elevator car stops, to record in memory the distance traveled by the elevator car onwards from the reference point.

20. The arrangement according to claim 8, wherein the monitoring apparatus is configured to stop a run with the hoisting machine, if the distance traveled by the elevator car onwards from the reference point exceeds the threshold value or if the elevator car stops.

* * * * *